US005379574A

United States Patent [19]

Fischer et al.

[11] Patent Number: 5,379,574

[45] Date of Patent: Jan. 10, 1995

[54] APPARATUS FOR PACKAGING INDIVIDUAL OBJECTS, ESPECIALLY PACKAGES, E.G. OF PREPACKED FOODSTUFFS

[75] Inventors: Georg Fischer, Velbert; Edgar Glätzer, Duisburg, both of Germany

[73] Assignee: Benz & Hilgers GmbH, Dusseldorf, Germany

[21] Appl. No.: 49,251

[22] Filed: Apr. 16, 1993

[30] Foreign Application Priority Data

Apr. 24, 1992 [DE] Germany ..... 4213555

[51] Int. Cl.[6] ..... B65B 7/26; B65B 11/06; B65B 35/50

[52] U.S. Cl. ..... 53/535; 53/540; 53/202; 53/207; 53/222; 53/376.5; 53/377.3

[58] Field of Search ..... 53/154, 234, 207, 225, 53/221, 535, 536, 540, 537, 222, 202, 376.5, 377.3

[56] References Cited

U.S. PATENT DOCUMENTS

| | | | |
|---|---|---|---|
| 1,851,457 | 3/1932 | Smith et al. | 53/535 X |
| 2,111,901 | 3/1938 | Ness | 53/535 X |
| 3,086,337 | 4/1963 | Engleson . | |
| 3,266,214 | 8/1966 | Kramme | 53/221 X |
| 3,323,273 | 6/1967 | Lee et al. | 53/221 X |
| 3,531,905 | 10/1970 | Omori | 53/535 X |
| 3,579,956 | 5/1971 | Hoffmann | 53/540 |
| 3,965,655 | 6/1976 | Schooler et al. | 53/225 |
| 4,463,541 | 8/1984 | Nowacki | 53/540 X |
| 4,711,066 | 12/1987 | Fox et al. | 53/540 X |
| 4,840,007 | 6/1989 | Focke et al. | 53/234 X |

FOREIGN PATENT DOCUMENTS

| | | |
|---|---|---|
| 0392478 | 10/1990 | European Pat. Off. . |
| 3301013 | 7/1984 | Germany . |
| 3639982 | 6/1987 | Germany . |
| 615100 | 12/1948 | United Kingdom . |

*Primary Examiner*—Linda B. Johnson
*Attorney, Agent, or Firm*—Herbert Dubno

[57] ABSTRACT

Grouped individual packages of prepackaged foodstuffs like butter, margarine, cheese and the like are packed in boxes by disposing a box blank at a receiving station aligned with a chamber and a turntable and mounting the layers of individual packages upon grouping on the blank. A hold-down and folding unit then displaces the layers and the blank into the chamber through a folding frame. The turntable and the folding frame can be displaced stepwise to accommodate two or more layers.

16 Claims, 4 Drawing Sheets

1
2
3
3a
4
9
11
12
13
14
15
16
18
19
21
22
23
24
27
27a
29
29a
30
33
34
35
36
37
38
39
41
42
43
44
45
46
47
48
49
52
53
54
60

APPARATUS FOR PACKAGING INDIVIDUAL OBJECTS, ESPECIALLY PACKAGES, E.G. OF PREPACKED FOODSTUFFS

FIELD OF THE INVENTION

The present invention relates to an apparatus for the packaging of grouped individual containers in a carton, box or other receptacle formed around the grouped packages. More particularly, the invention relates to an apparatus for the packaging of grouped individual packages, especially prepacked foodstuffs like individually wrapped soup or stock cubes, paper or foil wrapped butter, margarine and the like or even individual containers in a box or carton wherein the apparatus includes means for feeding the individual containers to a packaging location, means for feeding a blank of the enclosing packaging, e.g. a box or other receptacle blank, usually of cardboard, to the packaging location, means at the packaging location for forming the blank into a box, carton or like receptacle around the grouped packages, and means for discharging the receptacles filled with the individual packages.

BACKGROUND OF THE INVENTION

An apparatus for the assembling of individual packages into groups and for enclosing the grouped packages in a receptacle or box is taught, for example, in DE-OS 3 301 013.

That apparatus is especially designed for cup-shaped articles which can contain foodstuffs or the like. The articles to be packaged are delivered by a transport unit having a feed belt and can have a table containing a grouping chamber which is adjustable in height to allow the objects to be collected in groups which can, for packaging, be stacked on one another.

The transport device has a movable fork which has tines which engage groups of the individual containers to stack them.

In this case, the first group is deposited upon the table and successive groups are deposited upon the previously positioned groups on the table.

The stack which passes from the grouping chamber is introduced into an intermediate chamber in which a casing is applied to the stack which retains the integrity of the stack until it is subsequently wrapped with the final packaging material forming a box, carton or other receptacle around the stack of containers.

This earlier apparatus is expensive since the transport of the grouped articles from the incoming conveyor requires a height-adjustable fork which additionally must be provided with a slide displaceable in the horizontal direction. The back and forth movement of this slide and the fork requires comparatively considerable time for the transfer of the articles from the incoming conveyor belt to the raisable and lowerable table. As a result, a packaging machine of this type cannot operate with very high rates of cycling.

It is significant that the grouped containers must be additionally stored in intermediate chambers, for example, and depending upon the cycling rates, additionally horizontal movable shifters may be required for the intermediate storage.

The stack must be retained by the aforementioned casing which must be dimensioned to take up the entire collection of articles to be retained in the receptacle. Only after these steps are the collections of articles deposited on respective receptacle blanks and after the collected containers are deposited from the casing, the side walls of the receptacles are erected. The packaging material must usually be transported into a further pressing station for gluing of the parts of the receptacle to enable the package to be closed.

This system, therefore, requires a comparatively large number of stations and at least in some of these stations, the articles or containers to be packaged may be free to move about, to tilt or to otherwise become dislocated so that the elements of the apparatus cooperating with the grouped articles may not be able reliably to engage or manipulate them.

Indeed, it has been found to be the case when the articles are prepackaged foodstuffs, like butter, margarine or the like, that the individual containers may be damaged in handling.

Reference may also be had to DE 36 39 982 which discloses a device for the packaging of grouped individual objects in a box or other receptacle formed about the grouped containers and including a feed and collecting device for assembling the individual containers, a feed, fold and hold-down device for packaging material blanks, especially cardboard box blanks, and the formation of the box around the stacked containers as well as a discharge device for the full receptacle.

The feed device in this case extends into the region of a rotary unit having a vertical axis and referred to as an indexing device.

The system depends upon engagement of the packaging materials from above and likewise is not fully reliable.

OBJECTS OF THE INVENTION

It is, therefore, the principal object of the present invention to provide an apparatus for the packaging of grouped individual objects, especially packages of prepackaged foodstuffs like butter, margarine or the like, in a carton or box formed around the grouped individual containers, which apparatus is more compact and capable of operating at greater cycling rates than earlier systems.

Another object is to provide an apparatus for the purposes described which allows a largely problem free packaging of individual grouped packages of the type described without problems like those encountered with the prior art systems mentioned above.

Still another object of this invention is to increase the reliability of packaging machines of the type in which grouped individual articles, like rectangular blocks of foil or paper wrapped foodstuffs or other food packages, can be packaged in boxes or cartons at high speed.

SUMMARY OF THE INVENTION

These objects and others which will become apparent hereinafter are attained, in accordance with the invention in an apparatus for packaging grouped objects such as individual packages, especially of prepacked food products like soup or stock cubes, butter, margarine and the like which comprises:

- a turntable rotatable about a substantially vertical axis and formed with a plurality of angularly equispaced upwardly open receptacle-receiving chambers;
- drive means connected with the turntable for rotating the turntable to step the chambers to a receiving station and to a discharging station along a cyclical path of the chambers;

a feed and assembling device located close to the receiving station for feeding the individual packages to and grouping the individual packages at a location aligned with the receiving station;

a folder at the station registering with each of the chambers as each chamber is positioned at the receiving station;

feeding means for feeding a generally flat packaging blank, erectable into a receptacle for the grouped individual containers, onto the folder in alignment with a chamber of the turntable;

means for shifting the individual packages grouped at the location onto the blank;

a folding and hold-down device at the receiving station for engaging the blank and grouped individual packages thereon to be packaged for displacing the blank and the grouped individual packages through the folder and into the chamber at the receiving station, thereby erecting the receptacle from the blank around the grouped individual packages;

means at the discharge station for receiving receptacles filled with the individual packages from respective chambers positioned at the discharge station; and means for stepwise adjustment of a height of the turntable and of the folding and hold-down device to different receiving levels to enable formation of layers of the grouped individual packages in the receptacles.

According to the invention, therefore, the feeder for the individual packages extends substantially to the region of a turntable rotatable about a substantial vertical axis in a stepwise manner and which is provided with upwardly opening chambers adapted to receive the receptacle containing the individual packages as that receptacle, e.g. a box, carton or inverted box, is formed. Upon rotation of the turntable, the chambers can be successively aligned with a fold and hold-down unit which carries the receptacle blank into a chamber of the turntable aligned therewith and the receptacle containing the individual packages can then pass into the discharge station at which the receptacle is lifted from the chamber.

According to the invention, the turntable is adjustable in a vertical direction, i.e. as to its height, in a stepwise manner, including the fold and hold-down elements which cooperate with the chamber at the receiving station, so that layers of the individual package groups can be deposited on the blank directly, the vertical displacement of the turntable maintaining the receiving position of the latter for the successive layers of groups of individual packages.

With the system provided by the invention, the packing apparatus enables grouped individual packages and especially prepackaged foodstuffs like paper or foil-wrapped butter, margarine, cheese and the like or soup or stock cubes, to be packed in a box formed around the stack or in some other receptacle, while it is ensured that during the packaging the stacked individual packages can be reliably displaced without slipping or jamming and without tilting.

This is ensured because the packaging blank, i.e. the box blank of cardboard or the like is directly folded at the location at which the layer formation takes place.

Stated otherwise, the layers are formed on the packaging blank by displacing the turntable downwardly once one layer of the grouped individual packages are deposited thereon and then depositing the next layer on top of the first layer at the receiving station directly, etc.

The box walls as they are erected thus guide and hold in position the individual containers following the stacking operation and during box erection.

Another advantage of this system is that the configuration of the box formed at the receiving station is maintained by the chambering of the turntable until the box is removed from its chamber, thereby allowing any glue or other adhesive on the box walls or flaps to set or at least set sufficiently that spreading of the walls is precluded.

At the end of the packing process, even with multilayer stacking of the individual package groups, we are able to obtain a relatively stable box or carton which facilitates transport of the completed receptacle away from the apparatus.

In order to make the apparatus as compact as possible, the feed belts for the individual packages can extend over the turntable along a secant and, if desired, the belts for removing the finished packages, i.e. the boxes or receptacles with the individual packages, can likewise extend along secants over the turntable. The feeder for the cardboard blanks extends along a diameter of the turntable.

For the transfer of groups of individual packages from the assembly location to the folding and hold-down device, a transversely displaceable pusher is provided.

Preferably in the region of this pusher, a separately operated main folder is provided for folding inwardly an edge region of the blank while the means for swinging the flaps of the longitudinal sides of the packaging material inwardly, separate side folders are provided which can be suspended from parallelogrammatic linkages and which can be repeatedly withdrawn to retracted positions in which they do not interfere with the formation of the layers of the individual packages. In addition, depending upon the organization of the groups of individual objects, a support plate can be provided in the region of the pusher upon which the subsequent layers of objects can be positioned for transfer to the receiving location.

To improve the transfer of the grouped individual objects from the collecting location to the turntable in the region of the folding and hold-down device, preferably the folding and hold-down device comprises a shaft-forming folding box or frame which co-operates with the folding plunger of U-shaped cross-section and a hold-down plunger or plate which can be actuated separately from the folding plunger and can be driven by a piston-and-cylinder unit.

It has been found to be especially advantageous to close the bottom sides of the chambers formed in the turntable by a height-adjustable support plate or table which at diametrically opposite sides can have an opening for a support for the box blank at the receiving station and at the discharge station, an opening for a lifting plate adapted to lift the closed receptacle from the respective chamber into for example, an elevator on which the boxes of packages can be stored or forming part of the discharge unit.

The support at the receiving station can reach through the turntable chamber registering with the folding shaft and the folding shaft itself to provide support for the blank after it is fed over the folding shaft in the feed plane of the grouped packages and can be capable of supporting the blank within the perimeter of the folding shaft if the single layer of grouped packages or plural layers of grouped objects are deposited upon the blank.

The weight of the individual packages deposited on the blank, therefore, can be taken up by the support.

The lifting plate and the support can be coupled for joint elevation and descent.

The transfer of the cartons containing the individual packages from the elevator can be effected by a lateral shifter or slider which can deposit the boxes in succession upon the discharge conveyor which can be aligned with the feed conveyor for the individual packages or can be an extension thereof, lying along a secant of the turntable. This arrangement represents a significant simplification of the apparatus.

The support and the lifting device can be connected to a common bridge member mounted for movement parallel to the shaft of the turntable and provided with a height-adjusting mechanism independent from the height adjustment of the turntable and the underlying support table.

For a compact construction of the machine, it has been found to be of special advantage that substantially directly laterally of the feed belt for the individual packages, a stack of carton or box blanks is provided in an appropriate magazine having a feeder for withdrawing the blanks in succession from the bottom of this stack. Along the blank feed mechanism, a gluing device can be provided for applying glue to the flaps and/or edges of the blank, facilitating erection of the blank into the box configuration. The feed mechanism for the blanks can also be provided with a coding unit which signals the arrival or position of the blanks and enables the blanks to be fed particularly rapidly from the magazine.

The parallel arrangement of the blank feeder and the feeder of the individual packages has the advantage that, if necessary, directly alongside the discharge conveyor path, an additional magazine can be provided for the packaging blanks on an opposite side of the receiving station so that, for example, blanks may be fed from both sides of the latter utilizing the folding mechanism as a double shaft, whereby two boxes of individual objects can be formed simultaneously.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
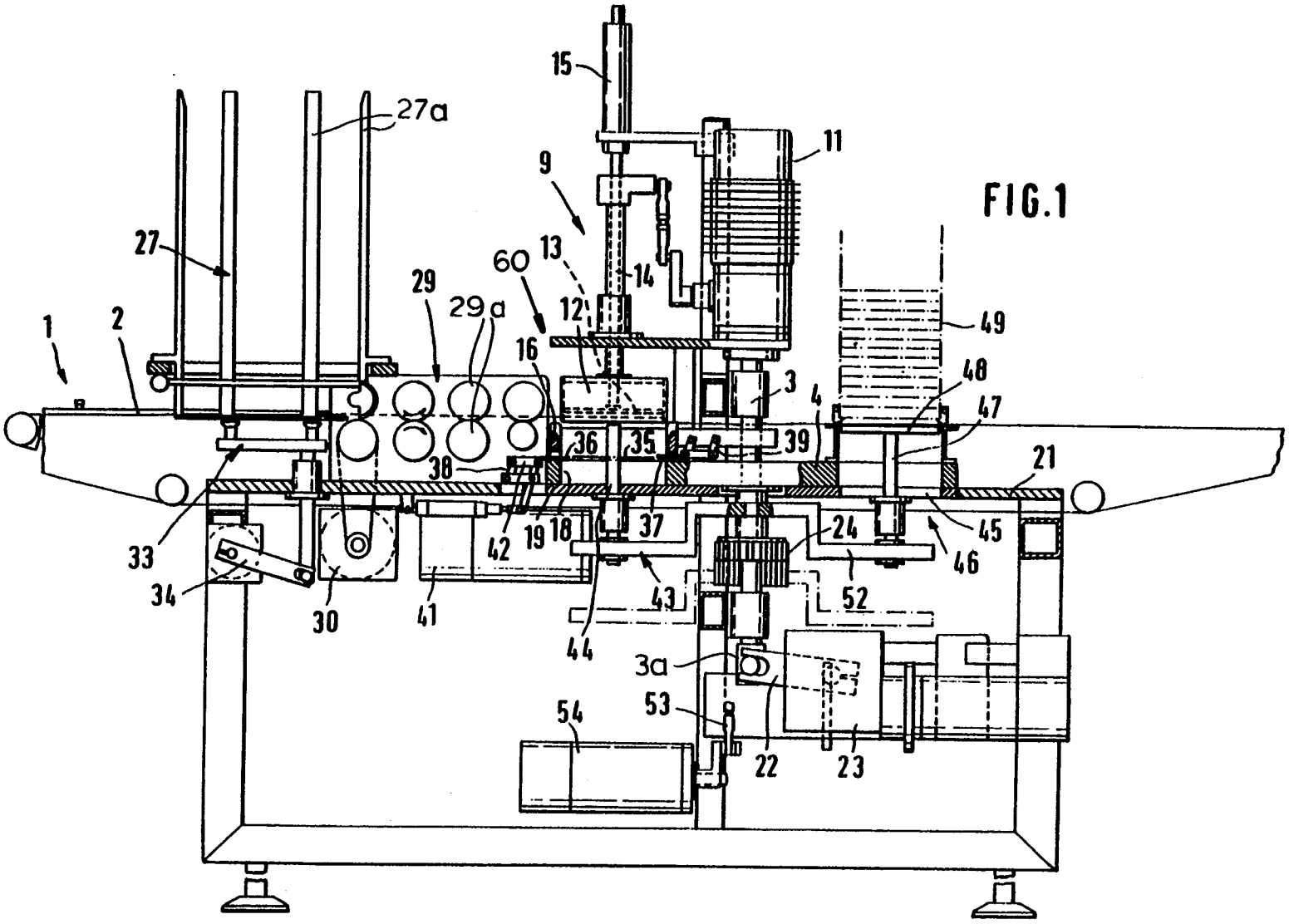
FIG. 1 is a front elevational view, partly in section, illustrating a packaging apparatus according to the invention.

In FIGS. 1, 2 and 4–7, we have shown an apparatus for the packing of grouped individual packages, especially prepacked foodstuffs like butter, margarine, cheese or the like as individual containers 6, in boxes, cartons or like packaging material (hereinafter referred to as receptacles) which can be erected around the individual containers and can be inverted boxes (i.e. in which the products are packaged upside down with respect to the final package configuration) or the like.

The apparatus comprises a feed device 1 in the form of at least one conveyor belt 2 and, as illustrated, in the form of two or more conveyor belts or a single conveyor belt divided into parallel stretches by guide rails, which extend secantially with respect to a turntable 4 rotatable about a substantially vertical axis on a vertical shaft 3 in a stepwise manner. In this case, the conveyor belt 2 continues across the turntable and there forms a discharge belt 5 which also extends along a secant of the turntable.

In a preferred embodiment, the feed belt has two parallel belts each of which carries a respective row of individual packages which come to engage an abutment 20 at a collection location at which the individual packages are collected in groups.

Figure 2:
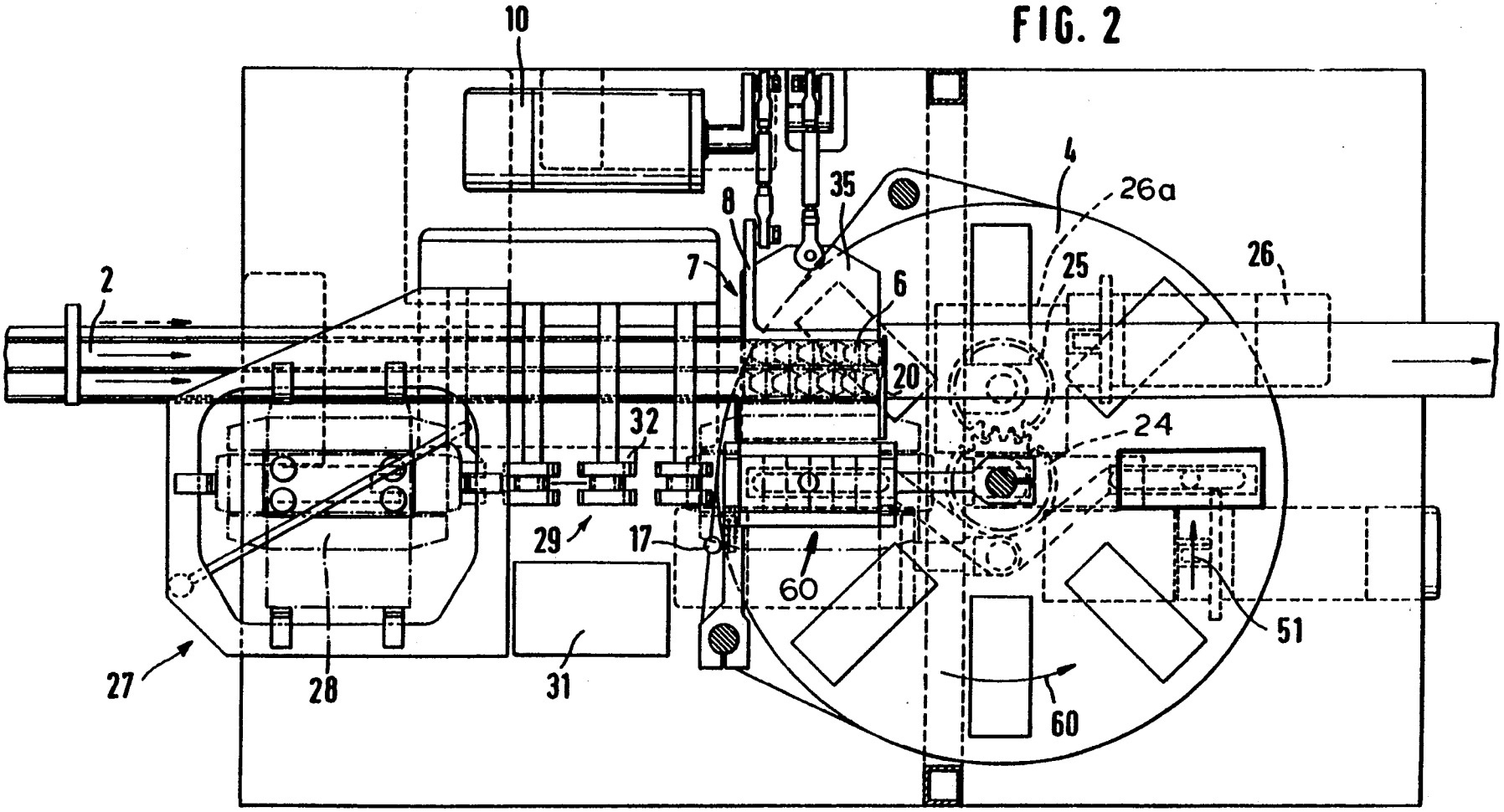
FIG. 2 is a plan view of the apparatus of FIG. 1.

In the embodiment illustrated in FIGS. 1 and 2, each group is formed by six individual packages so that twelve individual packages are displaced by a transverse shifter or slider 8 into the region of a folding and hold-down device 9.

This folding and hold-down device 9 is provided in vertical alignment or registry with a receiving station of the turntable 4.

As will be apparent from FIG. 1, the folding and hold-down device 9 comprises a motor 11, preferably a servomotor, driving a folding plunger or ram 12 vertically, the plunger 12 having a U-shaped cross section.

The folding plunger 12 cooperates with a hold-down plate 13 which is fastened on a hold-down rod 14 actuated by a vertical piston-and-cylinder unit 15.

Below the folding plunger 12 as can be seen in FIG. 1, the folding and hold-down unit 9 comprises a folding frame or shaft 16 also having a U-shaped cross-section which, for the purpose of replacement (when different receptacle formats are desired), is preferably constructed of a plurality of parts which can be locked together by a releasable locking element 17 represented only diagrammatically in the drawing (FIG. 2).

As is also apparent from FIGS. 1 and 2, the turntable 4 has a multiplicity of upwardly open angularly equispaced chambers 18 which, in the stepwise rotation, of the turntable, can be successively positioned at the receiving station in alignment or registry with the folding frame 16.

At their undersides, the chambers 18 are closed by a table plate 19 which does not rotate with the turntable but can be vertically displaceable therewith (or can be lowered independently of the turntable) and which, in its upper position, is substantially coplanar with the upper plate 21 of the frame of the apparatus.

The rotary turntable 4 and the nonrotary table plate 19, as well as the folding and hold-down unit 9, are vertically displaceable in a stepwise manner for the purpose of layer formation of the individual packages as will be described, for example, in connection with FIGS. 4–7.

Although not illustrated, in the feed plane for the packages or therebelow and below the feed belt 2, a storage plate can be provided to receive a layer of the grouped individual packages which can be deposited upon the box blank or a previously deposited layer.

The vertical adjustability of the turntable 4 can be effected by vertically displacing the shaft 3 of the turntable and, for that purpose, the shaft 3 can be journalled in a sleeve 3a which can be engaged by a pivot lever 22 forming an actuator for the lower end of the shaft 3. The lever 22 is coupled with a drive motor 23, preferably through a worm/worm wheel stepdown transmission located within the housing of the drive motor 23 and not shown in detail.

For rotation of the shaft 3 and the turntable 4 in the stepwise angular movement previously described, the shaft can be keyed to a driven gear 24 which meshes with a drive pinion 25 on the drive motor 26. A stepdown transmission 26a may be provided between the motor 26 and the pinion 25 (FIG. 2).

Directly laterally adjacent the feed conveyor 2, we provide a supply magazine 27 for the packaging or box blanks 28 which are stacked in the magazine. The latter may form a shaft defined by uprights 27a (FIG. 1) and the shaft can be open at the bottom to a feed device capable of drawing a single blank from the bottom of the stack and delivering it to the blank feeding unit 29 which can comprise rollers 29a driven by a motor 30 and feeding the blank 28 above the folding frame 16 to the receiving station which has been designated generally at 60 in FIGS. 1 and 2.

A gluing unit 31 can be provided along the path of the blanks 28 and can apply glue to flaps or edges of the blank adapted to be folded onto or against other flaps or edges and thereby seal the erected pack in its box configuration.

Also along the path of the blanks 28 is a coding device 32 which feeds signals representing the position of a blank to the control unit for the various drives of the machine so that, for example, the shifter 8 will not be actuated to transfer a layer of individual packages to the receiving station until a blank 28 is positioned in the receiving station to receive the layer of containers 6. The control unit may be a microprogrammed system or may include a combination of microprogrammed circuitry and limit switch circuitry for stepping the various motors, controlling a solenoid valve for actuating the piston-and-cylinder unit 15, etc.

The extraction of the lowermost blank 28 from the bottom of the stack in the supply magazine utilizes a suction device 33 which can be actuated by its own drive 34 to advance the blank into the roller feeder 29 as described.

Utilizing the feeder 29, therefore, the blank 28 is fed from the left over the folding shaft or frame 16. For erection and folding of the box, in the region of the shifter 8, a main folder 35 is provided which can be driven independently of the shifter 8 by a motor 10. A similar folder on the opposite side may be provided with a corresponding horizontal displacement as well unless a single large flap is folded in by the folder 35 shown.

For folding in the side flaps, side folders 36 and 37 are provided, each of which is suspended from or supported by a parallelogrammatic linkage and which can be driven by a motor 41 and corresponding actuating rods 42. The folders can be raised and lowered together with the frame 16 of the folding and hold-down unit represented at 9.

In the region of the folding frame 16, i.e. at the receiving station, a support device 43 is provided to engage the underside of the blank 28 disposed at the receiving station and preferably comprising a pin 44 which can reach up through the chamber 18 aligned with the shaft 16 and the folding shaft 16 itself. The pin 44 extends through a hole in the table 19 which is located at the receiving station.

At the diametrically opposite side of the table 19, the latter is formed with an opening 45 through which a lifting device 46 can extend, the lifting device can comprise a lifting plate 48 on a lifting ram 47.

The lifting plate 48 can meet the lower end of a system for temporarily storing the finished boxes, for example, in elevator 49 which can be capable of storing the cartons filled with the individual packages until the glue sets, especially in the case of a cold glue. From this elevator 49, as represented by the arrow 51 in FIG. 2, finished boxes or packs can be displaced by an appropriate pusher represented only by this arrow, onto the belt 5. Transfer plates can bridge spaces between conveyors or transporters where transfer or boxes or layers of individual packages are required.

The support unit 43 and the lifting unit 46 are interconnected by a bridge member 52 which is vertically displaceable on a shift 53 disposed parallel to the shaft 3 of the turntable 4 and vertically displaceable independently thereof. The drive motor 54 is connected with the shaft 53 for vertically displacing same.

Figure 3:
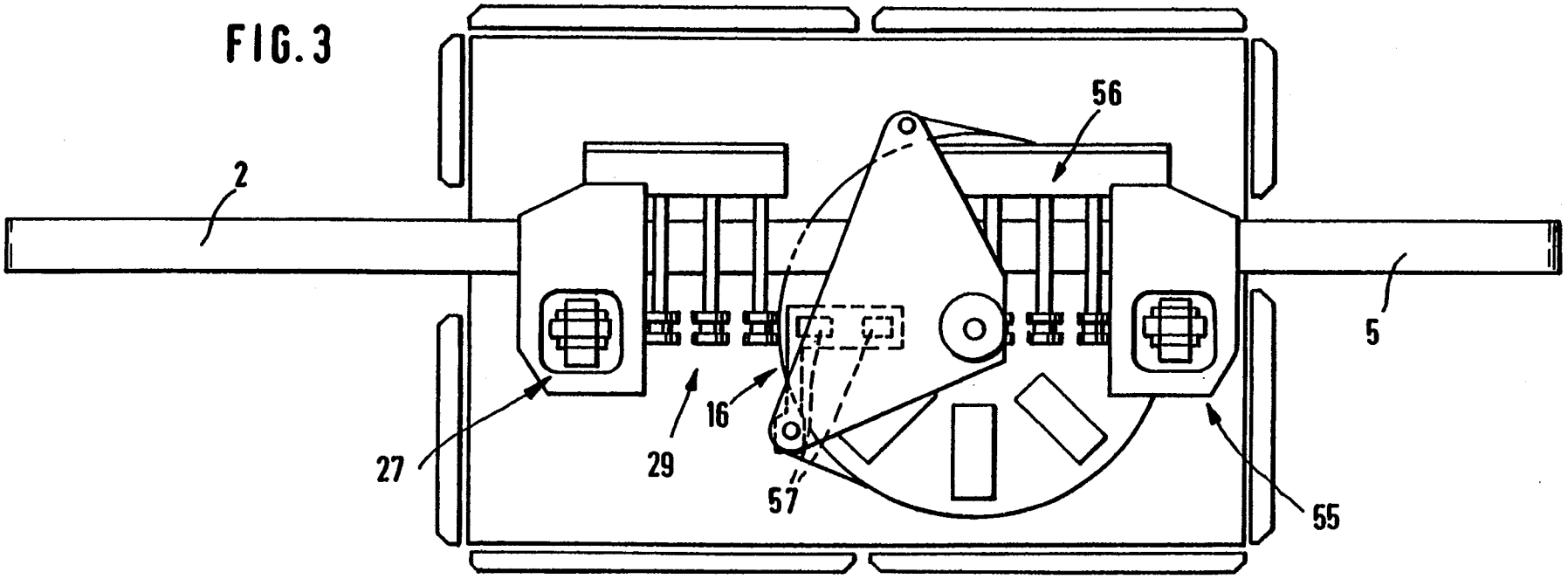
FIG. 3 is a diagram of an alternative embodiment also as seen in plan view.
Figure 4:
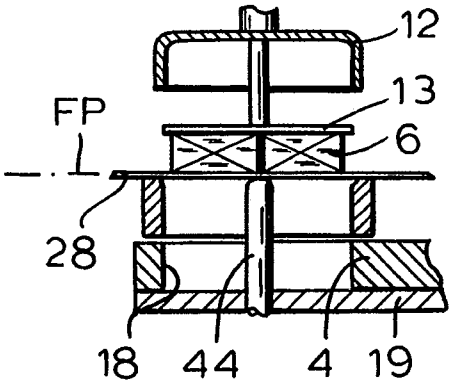
FIG. 4 is a diagram of an early stage in the packaging of a plurality of layers of objects (e.g. food packages), showing the positioning of a first layer on a box blank in highly schematic form.

In FIG. 3, we have shown an embodiment which is generally similar in structure and function to that described but which provides, in addition to the magazine 27 for supplying the blanks, an additional supply magazine 55 for the blanks in the region of the discharge belt 5. The two magazines can be used together when it may be desirable to provide smaller boxes containing the individual packages, for example, two boxes each of which holds half the number of packages of the larger pack. In this case, the folding frame 16 is replaced by a folding frame 57 forming a double shaft and each of the magazines has a rapid feeder supplying the respective receptacle blank to the receiving station. The apparatus thus allows rapid conversion from one type of packing to the other without any extended downtime of the apparatus.

As will be described in greater detail with reference to FIGS. 4–7, for the packing of the individual packages in single layer or plural layer boxes or cartons, the box blanks 28 are fed at the machine cycling rate from the magazine 27 to the receiving station above the folding frame 16 by the blank feeder 29.

Simultaneously, individual packages 6 are collected at the collecting location 7 into groups and the groups are then transferred laterally by the shifter 8 above the blank 28 into the receiving station. The individual packages are held in place by the hold-down plate 13 and with downward displacement of the folding plunger 12, the packages and the blank are pressed through the folding frame 16 into the chamber 18 of the turntable 4 disposed below the folding frame.

The upstanding flaps and edge regions of the box are initially bent inwardly along the respective score lines by the side folders 36 and 37 and the main folder 35 is then effective to permit the overlapping flaps to press together so that glue previously applied to the flaps causes the overlapping flaps and edge regions to be glued together.

Once the flaps have been folded inwardly, the turntable is rotated in the direction of arrow 60 by one step and the process is repeated.

If the support 44 is raised to support the new blank 28, the lifting plate 48 raises a finished box into the elevator 49 at the discharge location diametrically opposite the receiving station. For plural layer formation, the turntable 4 together with the mechanisms carried thereby are lowered stepwise by the height of a packing layer by corresponding adjustment of the height of the shaft 3. The finished boxes are then displaced from the elevator 49 onto the discharge belt 5 from which they are carried off.

Figure 5:
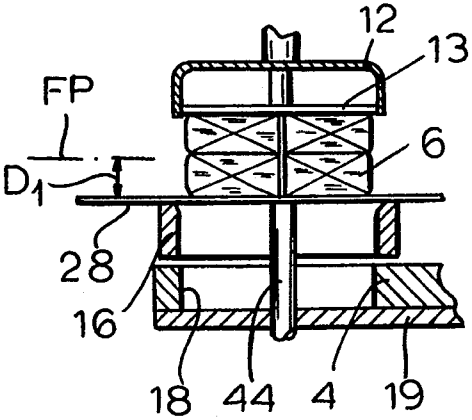
FIG. 5 is a diagrammatic section to FIG. 4 showing the positions of the turntable and the following end hold-down unit after it has been lowered to accommodate the second layer.
Figure 5A:
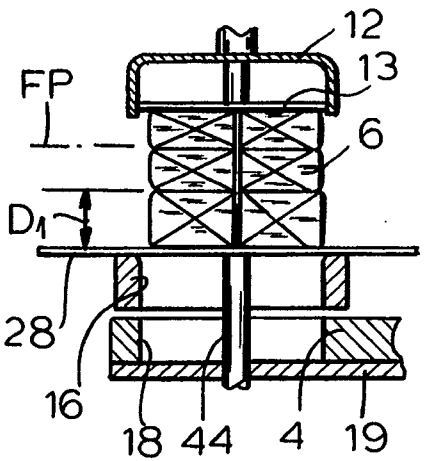
FIG. 5A is a diagrammatic sectional view of the turntable and a folding frame after they have been lowered to receive the third and last layer.

Referring to FIGS. 4 to 7, therefore, which shows diagrammatically a mode of operation of the apparatus of FIGS. 1 and 2 for the packing of three layers of food packages in each box or carton, it can be seen that initially the box blank 28 is located substantially in the feed plane FP of the grouped individual packages 6 and which can also represent the plane of an intermediate plate which has not been shown in greater detail otherwise and on which a layer of the individual packages can be stored. The layer is held in place by the hold-down device 13 as the frame 16, the turntable 18 and the support table 19 are lowered by a distance $d_1$ corresponding to the height of a layer (compare FIGS. 4 and 5). The hold-down 13 is then raised and a second layer of packages 6 is shifted in the feed plane FP onto the first layer (FIG. 5) and then, as is seen in FIG. 5A, upon a further combined downward movement of the frame 16 and the turntable at the distance $d_1$ a third layer is applied with each stack of layers being held in place by the hold-down 13.

Figure 6:
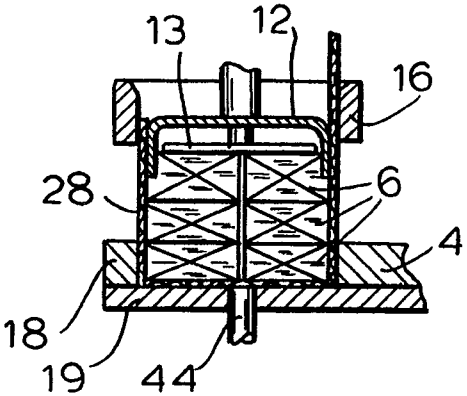
FIG. 6 is a diagrammatic section similar to that of FIGS. 4 and 5 and also highly schematic, illustrating the erection of the box and the receiving of the box as it is erected in the chamber of the turntable positioned at the receiving station.

The hold-down 13 and the folding plunger 12 are then lowered (compare FIGS. 5, 5A and 6) to displace the stack through the folding frame 16 movable upwardly and independently from the table plate 19, thereby folding the receptacle sides upwardly thus bringing end portions of the blank 28 between hold-down device 13 and respective inner surfaces of the frame 16 as shown in FIG. 6. Meanwhile the package is displaceable into the chamber 18 of turntable 4 (FIG. 6).

Figure 7:
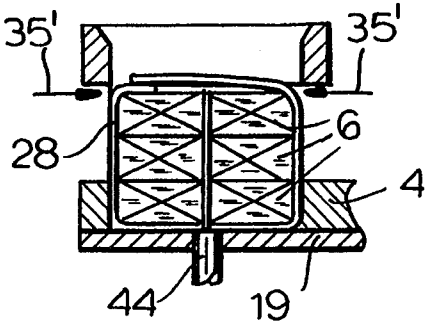
FIG. 7 is a further highly diagrammatic sectional view illustrating the folding over of the flaps of the box.

Upon retraction of the hold-down 13 and the folding plunger 12 (compare FIGS. 6 and 7) the flaps can be folded in the manner described and as represented by the arrows 35' in FIG. 7.

We claim:

1. An apparatus for packing grouped individual prepacked packages containing a food product, said apparatus comprising:

a turntable rotatable about a substantially vertical axis and formed with a plurality of angularly equispaced upwardly open receptacle-receiving chambers;

drive means connected with said turntable for rotating said turntable to step said chambers to a receiving station and to a discharging station along a cyclical path of said chambers;

a feed and assembling device located close to said receiving station for feeding the individual packages to and grouping said individual packages at a location aligned with said receiving station;

a displaceable folder at said location registering with each of said chambers as each chamber is positioned at said receiving station;

feeding means for feeding a generally flat packing blank, erectable into a receptacle for said grouped individual packages, onto said folder in alignment with a respective one of said chambers of said turntable;

means for shifting said individual packages grouped at said location onto said blank;

a folding and hold-down device at said receiving station for engaging said blank and grouped individual packages therein to be packed for displacing said blank and said grouped individual packages through said folder and into said one chamber at said receiving station, thereby erecting said receptacle from the blank around the grouped individual packages;

means at said discharge station for receiving receptacles filled with the individual packages from respective chambers subsequently arriving at said discharge station; and means for stepwise adjustment of a height of said turntable, said folder and of said folding and hold-down device to different receiving levels to enable formation of layers of the grouped individual packages in each of said receptacles, said means for stepwise adjustment including releasing means for displacing said folder independently from stepwise adjustment of said turntable and hold-down device.

2. The apparatus defined in claim 1 wherein said feed and assembling device includes a feed conveyor extending over said turntable along a secant thereof, said feeding means including a blank feeder extending along a diameter of said turntable parallel to said conveyor, a stop being provided along said conveyor at said location for assembling said individual packages into groups, said means for shifting including a shifter displaceable transversely of said conveyor and said feeder for displacing said groups onto a blank disposed at said receiving station.

3. The apparatus defined in claim 2, further comprising a main folder disposed at a side of said receiving station at which said shifter is provided for folding a flap of said blank inwardly upon receipt of said individual packages in an erected receptacle, said folding and hold-down device further comprising said folders adjacent said receiving station for folding further flaps of said blank inwardly.

4. The apparatus defined in claim 3 wherein said side folders each have a parallelogrammatic linkage mounting same for movement inwardly and outwardly of said receiving station.

5. The apparatus defined in claim 2 wherein said folding and hold-down device comprises a substantially U-section folding plunger disposed above said turntable at said receiving station in alignment with said folder and opening downwardly, and a hold-down plunger having a hold-down plate engageable with individual packages on a blank at said receiving station and actuated by a piston-and-cylinder unit.

6. The apparatus defined in claim 5 wherein said folder includes a shaft-forming folding frame formed of a plurality of releasably interconnected parts, said shaft-forming frame being U-shaped upwardly open frame at said receiving station aligned with a respective chamber of said turntable disposed at said receiving station, said U-shaped folding frame and said U-section plunger being displaceable diametrically opposite one another, so that respective side surfaces of said folding frame flank respective side surfaces of said U-section folding frame.

7. The apparatus defined in claim 5, further comprising an adjustable height support table disposed beneath said turntable and closing bottoms of said chambers, said support table having a lifting opening at a side thereof diametrically opposite said receiving station.

8. The apparatus defined in claim 7, further comprising a support device at said receiving station adapted to extend through a chamber of said turntable disposed at said receiving station and said folding frame to support a blank disposed at said receiving station, and a lifting device in the region of said lifting opening and lifting a receptacle filled with said individual packages from a chamber of said turntable aligned with said lifting opening.

9. The apparatus defined in claim 8 wherein said support device includes a pin extending upwardly through said support table and said lifting device includes a lifting ram with a lifting plate receivable in said opening and adapted to lift a receptacle into an elevator disposed above said lifting opening.

10. The apparatus defined in claim 9, further comprising a common bridge member adapted to be raised and lowered and carrying said pin and said lifting ram.

11. The apparatus defined in claim 10 wherein said bridge member is provided with a vertically displaceable shift parallel to said vertical axis of said turntable.

12. The apparatus defined in claim 2 wherein said discharge station includes a transport belt forming an extension of said feed conveyor.

13. The apparatus defined in claim 2 wherein said feed means includes a magazine for a stack of said blanks disposed laterally adjacent said feed conveyor.

14. The apparatus defined in claim 13 wherein said feeding means includes between said magazine and said turntable a blank conveyor provided with a gluing device for gluing flaps of said blank and a coating device for signalling position of a blank displaced along said blank feeder.

15. The apparatus defined in claim 12 wherein substantially directly laterally adjacent said belt an additional supply magazine for receptacle blanks is provided for feeding blanks to said receiving station from an opposite end of that at which said blanks are fed by said feeding means.

16. The apparatus defined in claim 15 wherein said folding frame forms a double shaft whereby two receptacles are formed simultaneously at said receiving station.

* * * * *